US010036158B2

(12) United States Patent
Espinosa

(10) Patent No.: US 10,036,158 B2
(45) **Date of Patent: *Jul. 31, 2018**

(54) CONCRETE ANCHOR

(71) Applicant: CETRES HOLDINGS, LLC, Jackson, WY (US)

(72) Inventor: Thomas M Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/268,568

(22) Filed: Sep. 17, 2016

(65) Prior Publication Data

US 2017/0101771 A1 Apr. 13, 2017

Related U.S. Application Data

(60) Continuation of application No. 14/579,820, filed on Dec. 22, 2014, now Pat. No. 9,447,574, which is a division of application No. 12/656,623, filed on Feb. 4, 2010, now Pat. No. 8,943,777.

(60) Provisional application No. 61/202,185, filed on Feb. 4, 2009.

(51) Int. Cl.

| | |
|---|---|
| ***E04C 3/02*** | (2006.01) |
| ***E04B 1/41*** | (2006.01) |
| ***E02D 35/00*** | (2006.01) |
| ***E04C 5/06*** | (2006.01) |
| ***E04C 5/16*** | (2006.01) |
| *E04B 1/35* | (2006.01) |
| *E04B 1/26* | (2006.01) |

(52) U.S. Cl.

CPC ..... *E04B 1/4157* (2013.01); *E02D 35/00* (2013.01); *E04B 1/4121* (2013.01); *E04B 1/4128* (2013.01); *E04C 5/0645* (2013.01); *E04C 5/16* (2013.01); *E04B 2001/2684* (2013.01); *E04B 2001/3583* (2013.01); *E04B 2001/4192* (2013.01)

(58) Field of Classification Search

CPC ... E02D 35/00; E04B 1/4157; E04B 1/14128; E04B 2001/3583; E04B 2001/4192; E04B 1/4121; E04B 2001/2684; E04B 1/4128; E04C 5/0645; E04C 5/16

USPC ..... 52/699, 295, 223.13, 126.7, 707, 704, 52/296, 297, 298, 292

See application file for complete search history.

(56) References Cited

U.S. PATENT DOCUMENTS

| | | | |
|---|---|---|---|
| 1,940,545 | A | 12/1933 | Holmes |
| 2,689,987 | A | 9/1954 | Berger |
| 3,157,966 | A | 11/1964 | Sherburne |
| 3,405,497 | A | 10/1968 | McNair |
| 3,514,917 | A | 6/1970 | Merrill, Sr. |
| 3,517,470 | A | 6/1970 | Luebkeman |
| 3,579,938 | A | 5/1971 | Hanson |
| 3,782,061 | A | 1/1974 | Minutoli et al. |
| 3,867,804 | A | 2/1975 | Wilson |
| 3,884,004 | A | 5/1975 | Douma et al. |
| 4,211,048 | A | 7/1980 | Naka |

(Continued)

*Primary Examiner* — Chi Q Nguyen

(74) *Attorney, Agent, or Firm* — Shlesinger, Arkwright & Garvey LLP

(57) ABSTRACT

An anchor rod support comprises a support having a floor and legs extending downwardly from the floor with openings between the legs; and the support including threads for attaching thereto an anchor rod.

6 Claims, 22 Drawing Sheets

(56) References Cited

U.S. PATENT DOCUMENTS

| | | | | |
|---|---|---|---|---|
| 4,250,681 | A | 2/1981 | Helderman | |
| 4,287,807 | A | 9/1981 | Pacharis et al. | |
| 4,325,575 | A | 4/1982 | Holt et al. | |
| 4,641,070 | A | 2/1987 | Pfizenmaier et al. | |
| 4,744,192 | A * | 5/1988 | Commins | 403/232.1 |
| 4,812,096 | A | 3/1989 | Peterson | |
| 4,945,704 | A | 8/1990 | Brown, Jr. | |
| 5,081,811 | A | 1/1992 | Sasaki | |
| 5,205,690 | A | 4/1993 | Roth | |
| 5,375,384 | A * | 12/1994 | Wolfson | E04L 31/0007 52/295 |
| 5,653,078 | A | 8/1997 | Kies et al. | |
| 5,653,563 | A | 8/1997 | Ernst et al. | |
| 5,772,372 | A | 6/1998 | Lins et al. | |
| 5,957,644 | A | 9/1999 | Vaughan | |
| 6,135,687 | A | 10/2000 | Leek et al. | |
| 6,195,949 | B1 | 3/2001 | Schuyler | |
| 6,240,697 | B1 | 6/2001 | Thompson et al. | |
| 6,341,452 | B1 | 1/2002 | Bollinghaus | |
| 6,393,795 | B1 | 5/2002 | Irwin et al. | |
| 6,513,300 | B1 | 2/2003 | James | |
| 6,904,728 | B2 | 6/2005 | Stutts | |
| 7,150,132 | B2 * | 12/2006 | Commins | |
| 7,296,382 | B2 | 11/2007 | Sack | |
| 7,766,299 | B2 | 8/2010 | Titus et al. | |
| 7,921,616 | B2 | 4/2011 | Reyneveld | |
| 8,136,318 | B2 | 3/2012 | Espinosa | |
| 8,381,482 | B2 | 2/2013 | Lin et al. | |
| 8,621,816 | B1 | 1/2014 | Lin et al. | |
| 8,943,777 | B2 | 2/2015 | Espinosa | |
| 9,222,251 | B2 * | 12/2015 | Espinosa | |
| 9,447,574 | B2 * | 9/2016 | Espinosa | E02D 35/00 |
| 9,702,139 | B2 * | 7/2017 | Espinosa | |
| 2005/0055897 | A1 | 3/2005 | Commins | |
| 2013/0025234 | A1 | 1/2013 | Lin et al. | |
| 2013/0067849 | A1 | 3/2013 | Espinosa | |

* cited by examiner

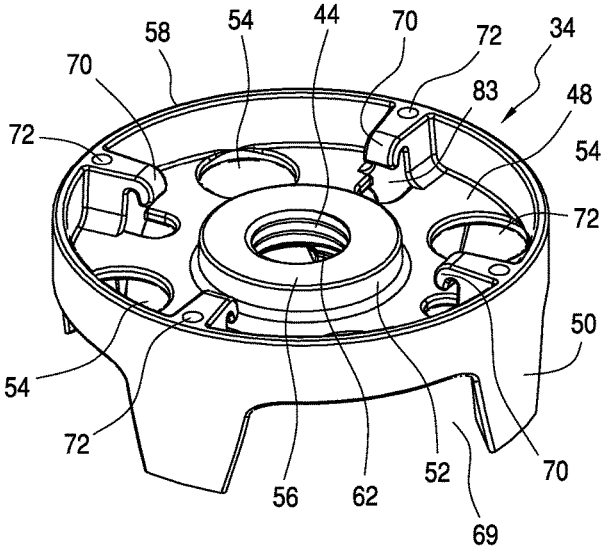
FIG. 6
FIG. 5
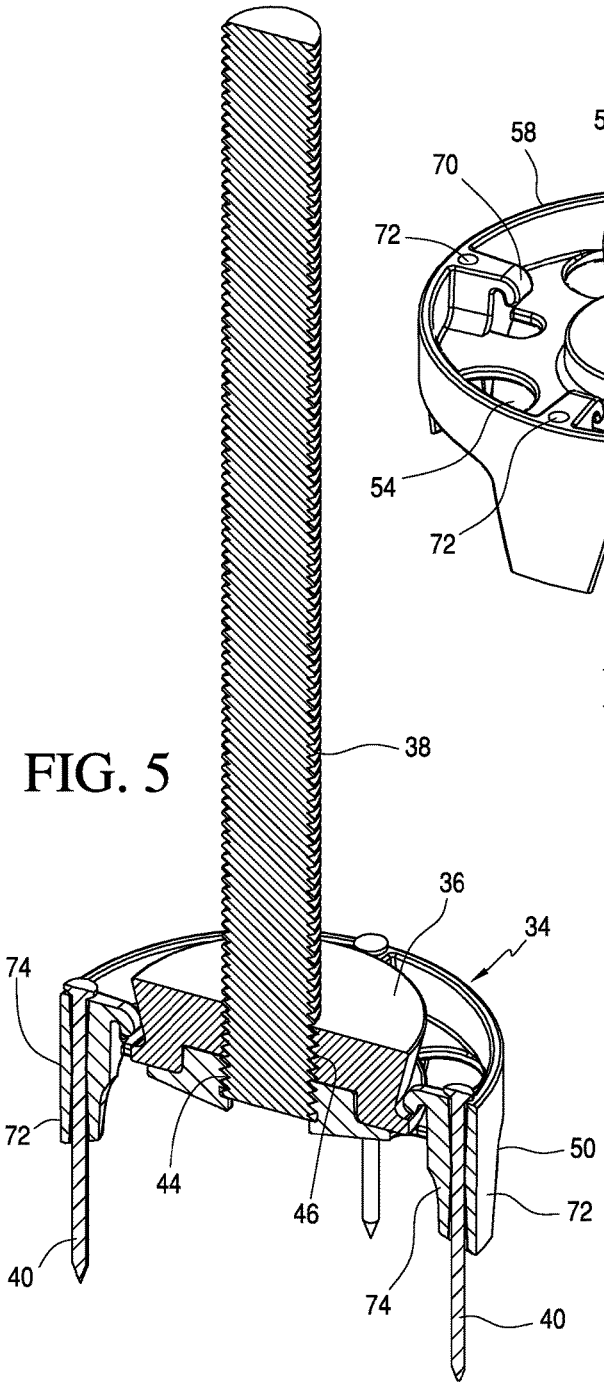

FIG. 7
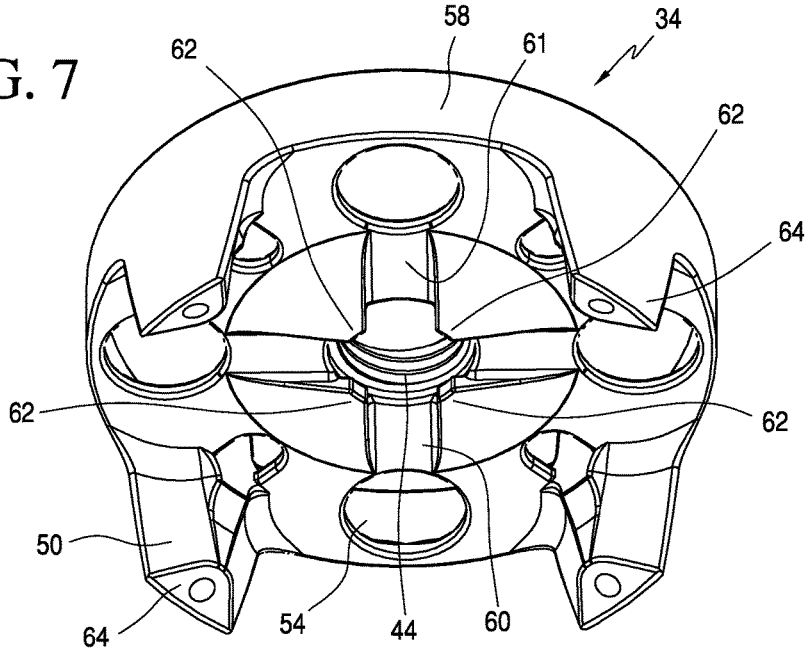
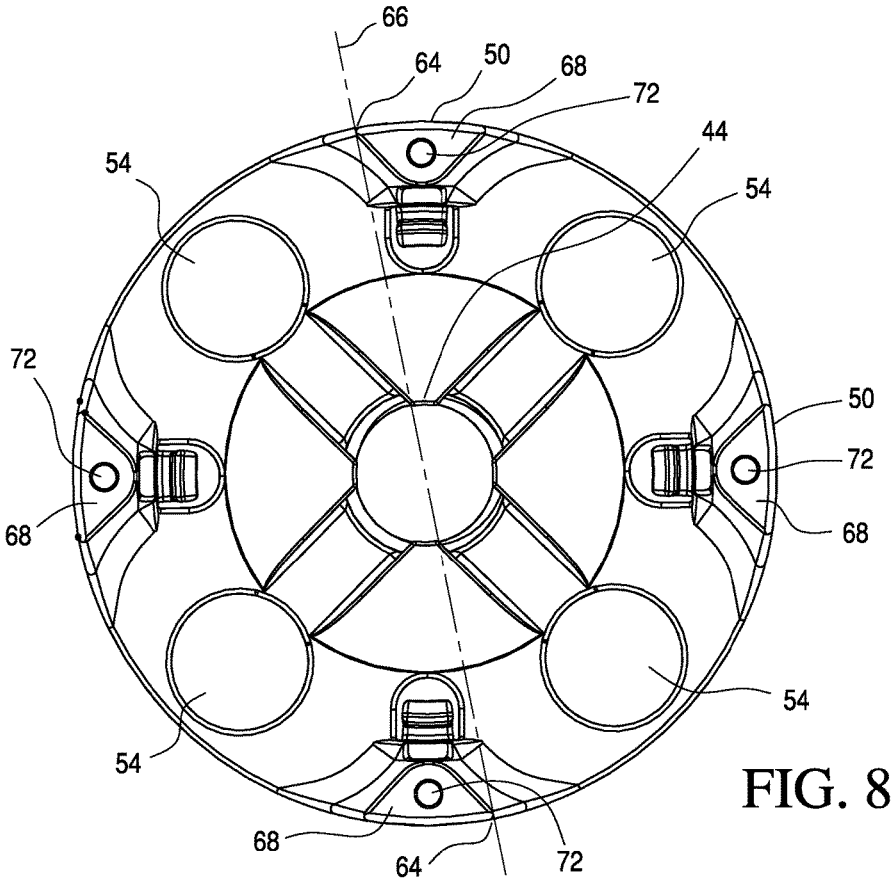
FIG. 8

CONCRETE ANCHOR

RELATED APPLICATIONS

This is a continuation application of application Ser. No. 14/579,820, filed on Dec. 22, 2014, now U.S. Pat. No. 9,447,574, which is a divisional application of application Ser. No. 12/656,623, filed on Feb. 4, 2010, now U.S. Pat. No. 8,943,777, which claims the priority benefit of Provisional Application Ser. No. 61/202,185, filed Feb. 4, 2009, and the above-mentioned applications are hereby incorporated by reference.

FIELD OF THE INVENTION

The present invention relates generally to an anchor embedded in a concrete structure for transferring load to the concrete structure, and particularly to an anchor embedded in a concrete structure, such as a foundation, beam or deck for attaching thereto another structure, such as a wall.

SUMMARY OF THE INVENTION

The present invention provides an anchor for attaching a structure to a concrete structure, comprising an anchor rod having a lower threaded portion for being embedded in a concrete structure and an upper portion for extending outside the concrete structure; an anchor body including a first threaded central opening for threadedly receiving one end portion of the lower portion; and a support including a floor. The support includes a second central threaded opening through the floor portion for threadedly receiving another end portion of the lower portion.

The present invention also provides a holder for an anchor rod, comprising a molded support including a floor portion, the support having an overall circular shape in plan view. The support includes a central threaded opening through the floor portion for threadedly receiving an end portion of an anchor rod; and the floor portion has a bottom surface for resting on a surface prior to the support being embedded in concrete.

The present invention further provides a holder for an anchor rod, comprising a molded support including a floor portion, the support including a plurality of leg portions attached to said floor portion and extending downwardly therefrom. The support includes a central threaded opening through said floor portion for threadedly receiving an end portion of an anchor rod. The support includes a vertical peripheral wall portion attached to the floor portion and the leg portions, the wall portion extending above the floor portion; and the leg portions extending above the floor portion and attached to the wall portion.

The present invention provides a holder for an anchor rod, comprising a molded plastic support including a floor portion and leg portions extending downwardly therefrom; the support including a central threaded opening through the floor portion for threadedly receiving an end portion of an anchor rod; and the floor portion including a plurality of openings to facilitate flow of concrete slurry to underneath the floor portion.

BRIEF DESCRIPTION OF THE DRAWINGS

FIG. 5 is a cross-sectional view taken along the line 4-4 in FIG. 4.

FIG. 6 is a perspective view of an anchor rod support made in accordance with the present invention.

FIG. 7 is a perspective view of the underside of FIG. 6.

FIG. 8 is a plan view of the underside of FIG. 6.

DETAILED DESCRIPTION OF THE INVENTION

Figure 1:
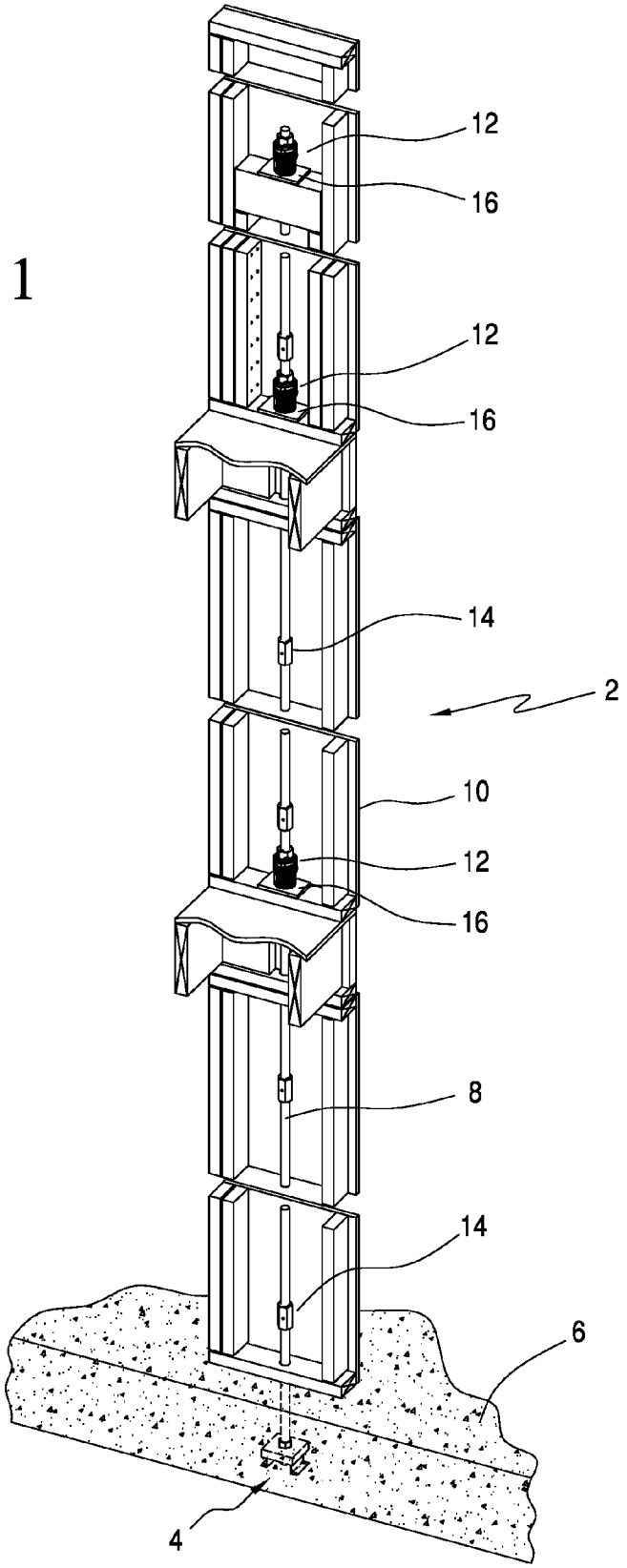
FIG. 1 is a perspective view of a portion of a wall system anchored to a concrete structure.

Referring to FIG. 1, a wall system 2 comprises an anchor 4 embedded in a concrete structure, such as a concrete deck, beam, slab or foundation 6. The anchor 4 is used to transfer load to the concrete structure. The load may be in the form of another structure, such as a wall, required to be tied down to the concrete structure 6.

Using as an example a wall that is required to be secured to a concrete foundation or decking, the anchor is connected to a tie rod 8 that extends inside a stud wall 10 through several floors. The tie rod 8 is secured to the wall 10 at several locations with a fastener assembly 12 that expands to take up any slack that may develop in the tie rod due to wood shrinkage, load compression, load shifting, etc. after installation. Connectors 14 are used to connect several sections of the tie rod 8 to make one interconnected continuous length. Bearing plates 16 are used to spread the force exerted by the fastener assemblies 12 over the wood members. Examples of the fastener assemblies 12 are disclosed in applicant's co-pending application Ser. No. 11/898,479, herein incorporated by reference.

Figure 2:
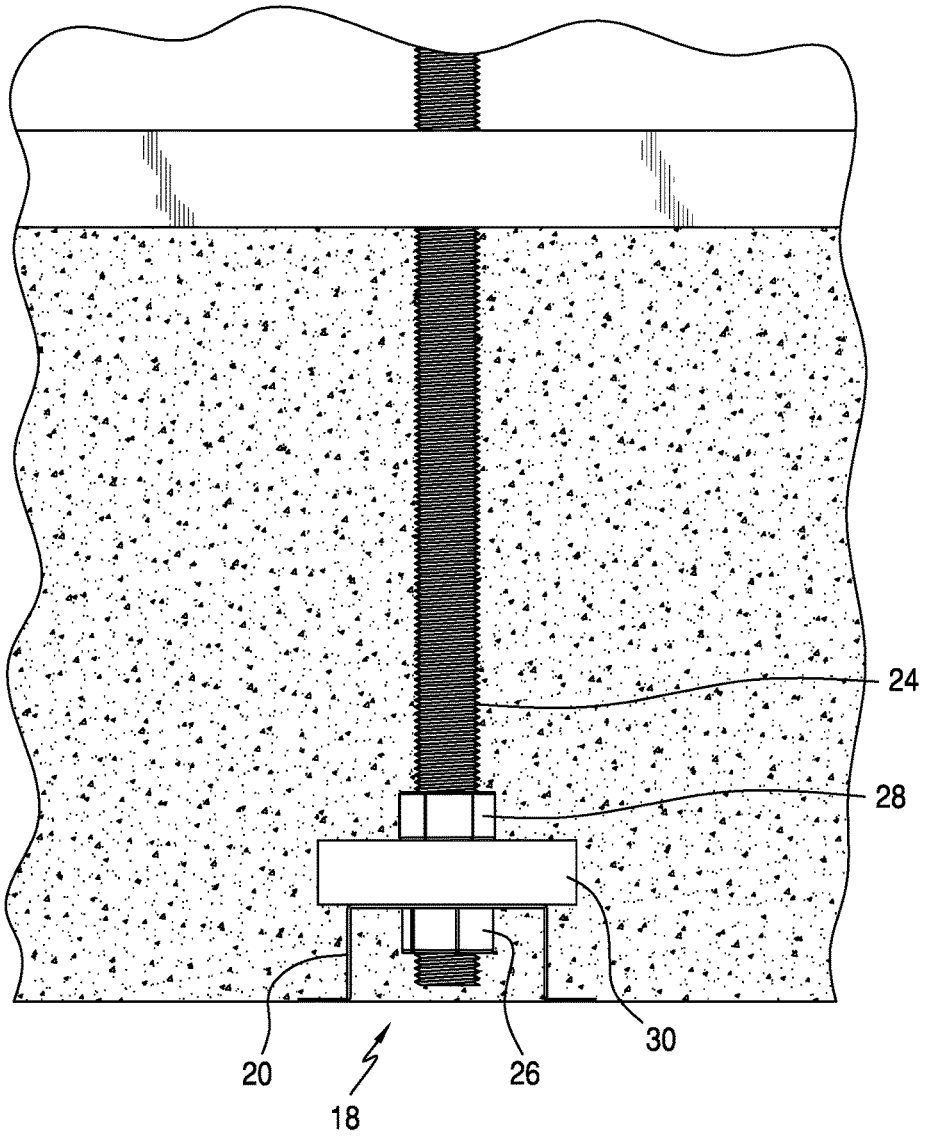
FIG. 2 PRIOR ART
FIG. 2 is a side elevation view of a prior art anchor shown in FIG. 1.
Figure 3:
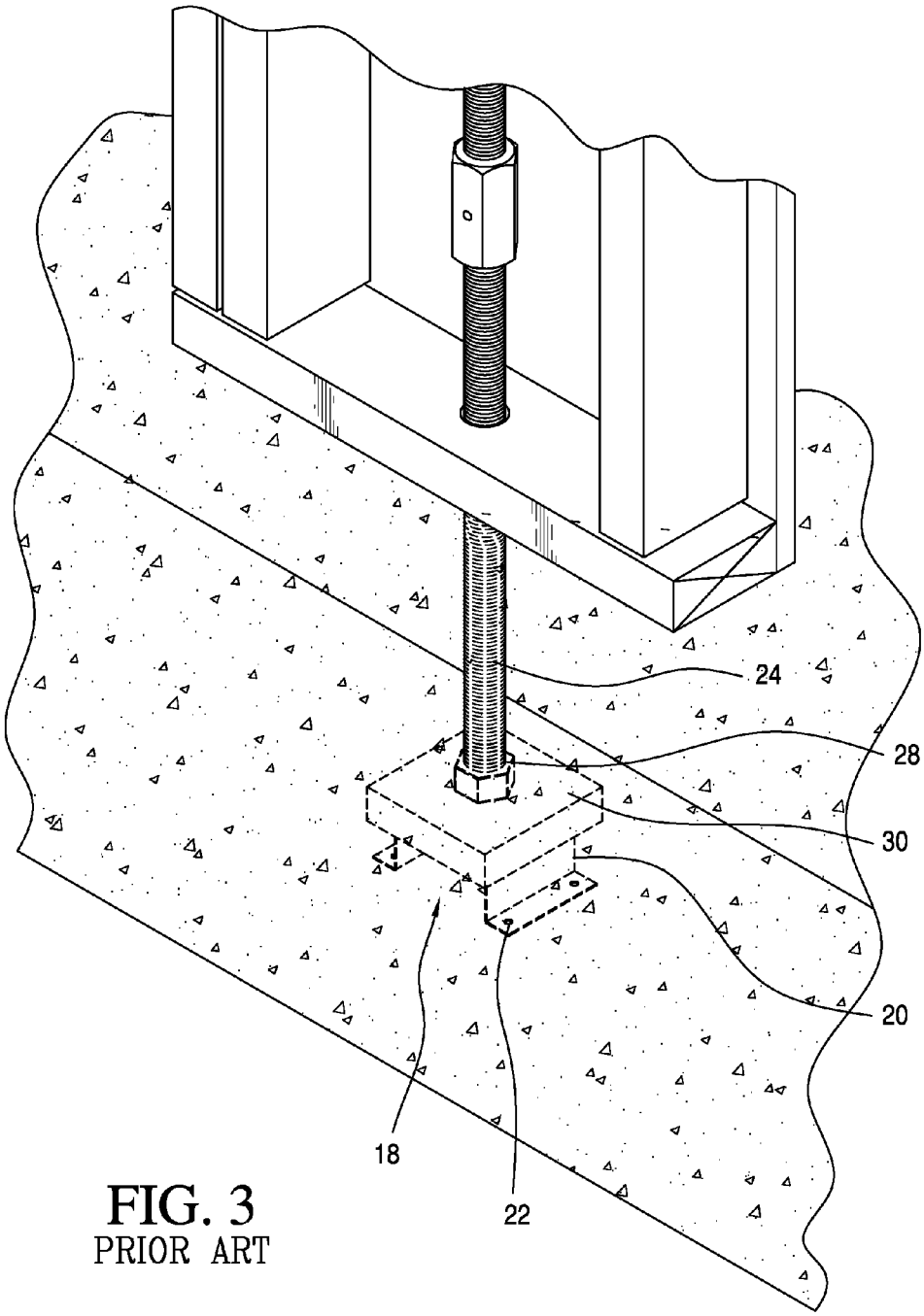
FIG. 3 PRIOR ART
FIG. 3 is a perspective view of FIG. 2.

Referring to FIGS. 2 and 3, a prior art anchor 18 includes a U-shaped sheet metal support 20 secured to a form board by means of nails through holes 22. A threaded anchor rod 24 has its one end secured to the support 20 by means of a bottom nut 26 and a top nut 28. An intervening plate 30 seats on top of the support 20.

Figure 4:
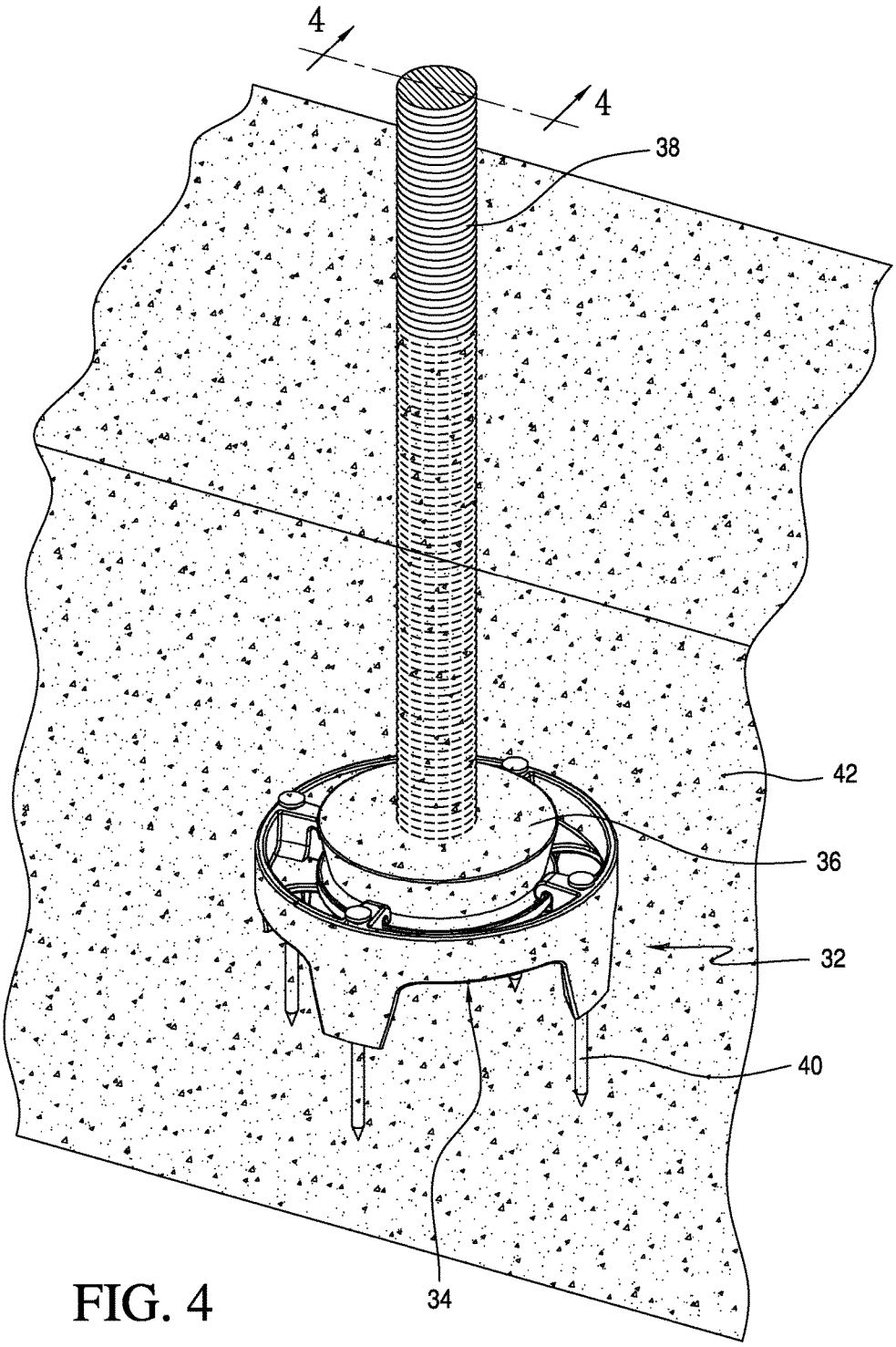
FIG. 4 is a perspective view of an anchor made in accordance with the present invention.

An anchor 32 made in accordance with the present is disclosed in FIG. 4. The anchor 32 includes a holder or support 34, an anchor body 36 and an anchor rod 38. The anchor rod 38 may be all-threaded or partially threaded (see FIGS. 20 and 21). The support 34 is attached to a surface, such a board (see FIG. 17) forming part of a concrete form, by means of nails 40 prior to pouring of the concrete structure 42 in which the anchor 32 will be embedded.

The support 34 is preferably made of plastic, molded in one piece by injection molding. The support 34 is a holder for the anchor rod 38 and the anchor body 36 prior to pouring the concrete. The support 34 is preferably color-coded for the size of the anchor rod 38, the pitch of the threads of the anchor rod, the strength of the anchor rod and/or the type of the anchor body 36. The anchor body 36 and the anchor rod 38 are preferably made of steel.

In use, the lower portion of the anchor rod 38 is embedded in the concrete structure 42 while its upper portion protrudes outside for connection to a structure required to be tied down, such as the wall structure 2, using conventional connectors, such as a nut, a threaded coupler, a ring attached to the end of the anchor rod, etc.

Referring to FIG. 5, one end of the anchor rod 38 is threadedly secured to the support 34 through a threaded central opening 44. The anchor body 36 is threaded through the anchor rod 38 through a threaded central opening 46.

Figure 17:
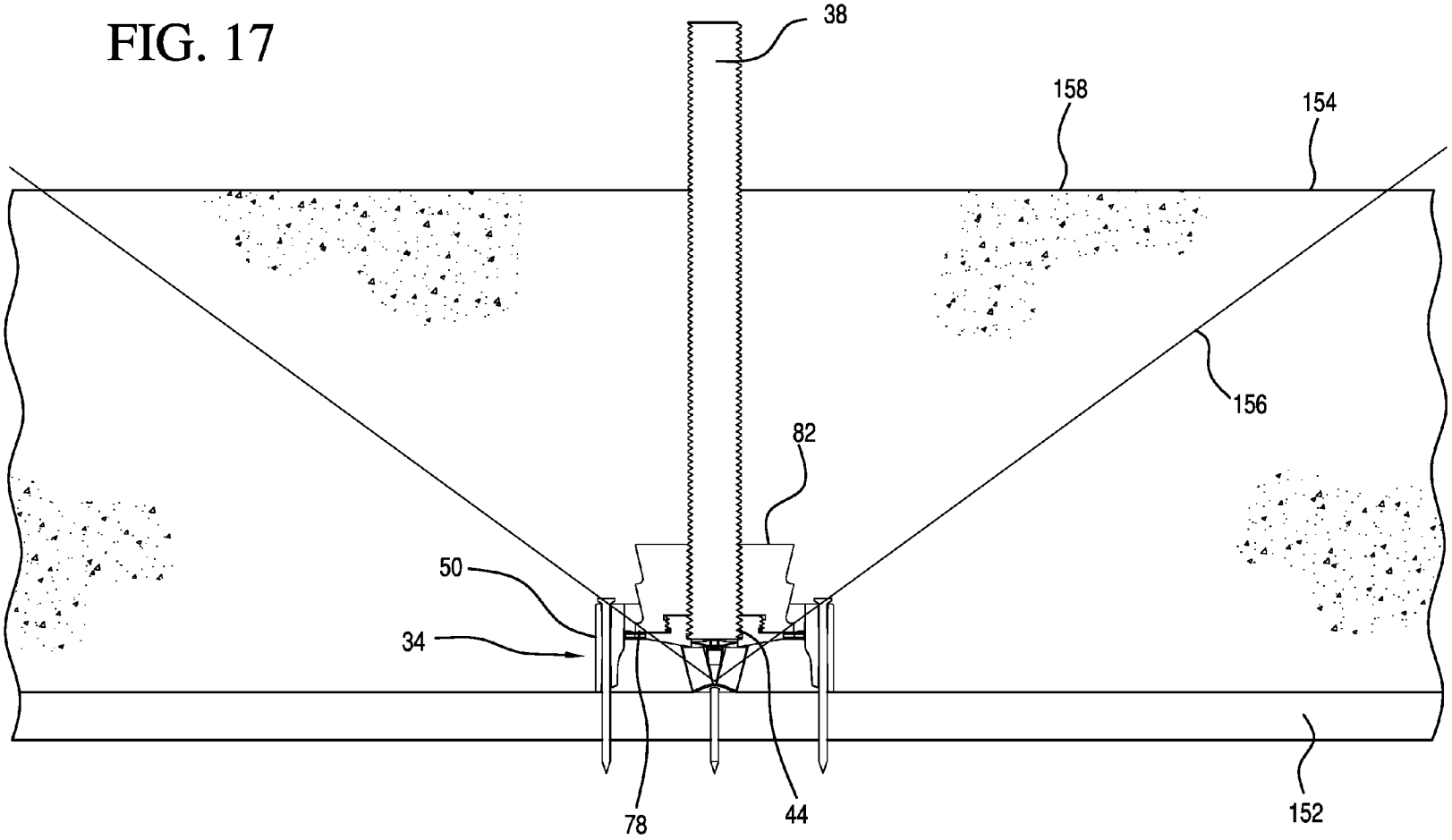
FIG. 17 is a side elevational view of the embodiment of FIG. 10, showing a shear cone which is generated when the anchor is subjected to tension forces through the anchor rod.

Referring to FIGS. 6 and 7, the support 34 has a base or floor portion 48 supported by a plurality of leg portions 50 above the surface within the concrete form (see FIG. 17). The floor portion 48 includes a raised portion 52 through which the threaded central opening is disposed. The raised portion 52 has a top surface 56 that is engaged by the anchor body 36 when secured to the anchor rod 38 to set up and stabilize the anchor rod 38 in the vertical position. The raised portion 52 is thicker than the adjacent floor portion 48 to advantageously provide greater holding strength to the anchor rod 38.

A plurality of openings 54 facilitate the flow of concrete slurry to underneath the floor portion 48 and to provide means for air from underneath to escape during concrete pouring, thereby minimizing the formation of air pockets that could weaken the concrete structure and the anchorage.

A vertical, preferably cylindrical peripheral wall portion 58 provides stiffness and rigidity to the floor portion 48. The wall portion 58 is attached to the periphery of the floor portion 48. The leg portions 50 extend above the floor portion 48 and are attached to the inside surface of the cylindrical wall portion 58.

The underside of the floor portion 48 includes a plurality of channels 60 that communicate with respective openings 54 and the bottom end of the opening 44 to provide a way for air trapped underneath the bottom of the anchor rod 38 to escape, as shown in FIG. 7.

Projections 62 extend into the opening 44 at the bottom end of the opening 44. The projections or thread stops 62 limit the downward travel of anchor rod 38 as it is screwed into the opening 44, thereby insuring that the bottom end of the anchor rod is completely threaded within the opening 44. The thread stops 62 prevent the anchor rod 38 from projecting downwardly past the floor portion 48 and thereby interfere with flow of concrete slurry below the floor portion 48. The channels 60 have ceilings 61 disposed slightly above the projections 62 such that an air pocket that may form within the volume of space within the opening 44 below the bottom surface of the anchor rod 38 when it is fully engaged with the projections 62 will be relieved through the channels 60. Further, the thread stops 62 provide to insure that the bottom end of the anchor rod 38 is at the right distance above the surface or form board on which the leg portions rest within the concrete form to allow unimpeded flow of concrete slurry containing a certain size stone used in the concrete mix.

The underside of the floor portion 48 is advantageously flush with the bottom edge of the cylindrical wall portion 58 to avoid forming any chambers where air may be trapped. Further, the leg portions 50 are substantially triangular in cross-section to provide a streamlined face and thereby facilitate the flow of the concrete slurry underneath the floor portion 48.

The leg portions 50 may be any number for stability, preferably three or more, as discussed below. The support 34 is disclosed with four leg portions 50 to define the four corners of a square so that the bottom corners 64 of two opposite leg portions 50 may be used to line up the support 34 along a framing layout line 66 made on the form board, whereby the center of the opening 44 will line up with layout line 66, as shown in FIG. 8, thus centrally positioning the anchor rod 38 on the layout line.

The bottom surfaces 68 of the leg portions 50 are advantageously made visible after the form boards are removed. Since the support 34 is color-coded, the visibility of the bottom surfaces 68 provides a means for determining whether the correct anchor has been used.

The use of four leg portions 50 provides a substantial opening or space 69 between adjacent leg portions to facilitate the flow of the concrete slurry underneath the floor portion 48. The openings 54 are advantageously disposed along the flow of concrete slurry between adjacent leg portions 50 allow any air pockets that may develop to escape, as shown in FIG. 7.

Referring back to FIG. 6, flexible fingers 70 are provided for retaining the anchor body 36 to the support 34 prior to the anchor rod 38 being threaded to the anchor body 36 and to the support 34.

It will be seen that the support 34 holds the anchor rod 38 vertically with its bottom end at a certain distance from the form board depth prior to the concrete being poured. The support 34 also provides adequate space underneath the floor portion 48 to allow the concrete slurry to flow during a concrete pour, while minimizing the formation of any air pockets. The leg portions 50 are evenly distributed around the cylindrical wall portion 58. Use of four leg portions 50 provides for four openings between adjacent leg portions 50 to provide multiple inlets and outlets for the concrete slurry, thereby eliminating any dead-end chambers where air pockets may form underneath the floor portion 48.

Referring back to FIG. 5, the leg portions have vertical holes 72 that hold the nails 40. The holes 72 extend through the length of the leg portions, from one end to the other end. The nails 40 are pre-installed in the holes 72. The holes 72 have narrowed or constricted portions 74, thereby to frictionally hold the nails 40 and prevent them from falling out of the holes prior to being driven into the form boards. The tips of the nails 40 are disposed inside the holes 72 prior to being driven into the form board, although they are shown after having been driven down into the form board (see FIG. 17).

Figure 9:
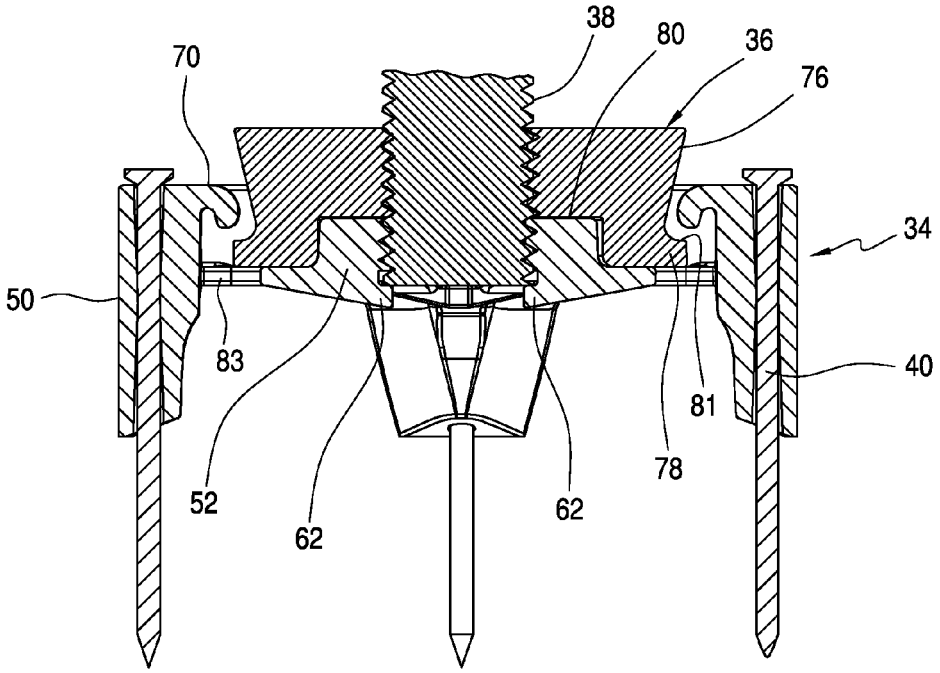
FIG. 9 is a side elevational view of FIG. 5.

Referring to FIG. 9, the anchor body 36 has an inverted conical portion 76 with a bottom circumferential shoulder 78 that extends outwardly in a radial direction to provide a shoulder. The shoulder portion 78 has an outside diameter larger than the clearance distance between two opposite flexible fingers 70 such that the anchor body 36 is retained by the support 34 prior to threading the anchor rod 38. The flexible fingers 70 are sufficiently resilient to permit bending thereof so that the anchor body 36 may be pushed in past the flexible fingers 70 and thereby be retained to the support 34.

The anchor body 36 has a bottom recess 80 configured to receive therein the raised portion 52, thereby allowing the lowering of the shoulder portion 78. In structural analysis, when the anchor rod 38 is put under tension, a shear cone is generated in the concrete structure. The lower the lowest possible concrete engagement points of the anchor body are, the larger the shear cone will be. The larger the shear cone, the stronger will the anchorage be. In this case, the lowest concrete engagement points of the anchor body 36 are on the shoulder portion 78, with its substantially horizontal and curved surface 81 to grab the concrete.

The leg portions 50 extend above the floor portion 48, as shown in FIG. 9. The flexible fingers 70 extend from the top ends of the leg portions 50 in a cantilevered manner. Openings 83 are provided on the floor portion 48 next to the leg portions 50 to provide additional escape passageways for air that may be trapped underneath the floor portion 48 during concrete pouring.

Figure 10:
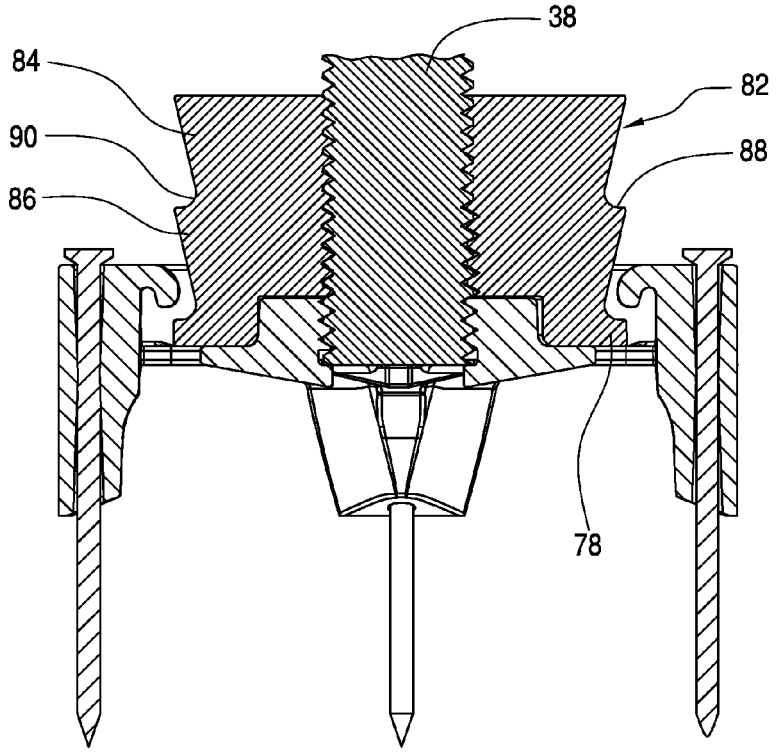
FIG. 10 is a cross-section view similar to FIG. 9, showing another embodiment of an anchor body.

Another embodiment of an anchor body 82 is disclosed in FIG. 10. Anchor body 82 is similar to the anchor body 36, except that the anchor body 82 has an upper conical portion 84, in addition to a lower conical portion 86. An outwardly extending shoulder 88 is disposed at the bottom portion of the upper conical portion 84. The shoulder 88 is circumferential and provides a substantially horizontal and curved surface 90 for grabbing the concrete, in addition to the surface 81 provided by the bottom shoulder portion 78, when the anchor is placed under tension.

Figure 11:
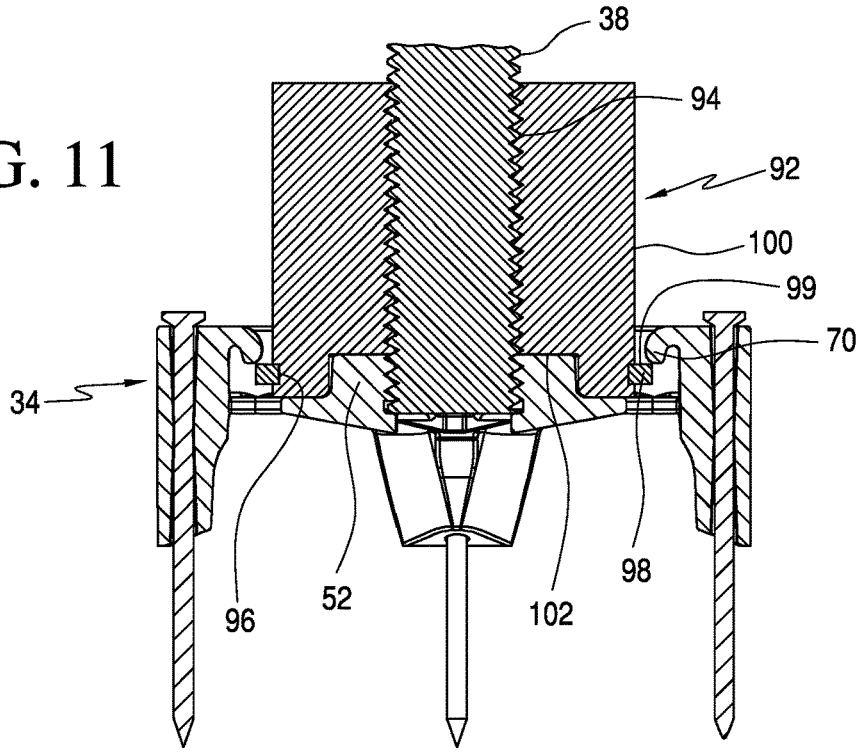
FIG. 11 is a cross-sectional view similar to FIG. 9, showing another embodiment of an anchor body.

Another embodiment of an anchor body 92 is disclosed in FIG. 11. The anchor body 92 is a cylindrical body with a threaded central opening 94 for threaded attachment to the anchor rod 38. A circumferential groove 96 is disposed at the bottom portion of the anchor body 92. The groove 96 receives a split or C-ring 98, rectangular in cross-section, with a portion 99 extending beyond the cylindrical surface 100 of the anchor body 92. The extending portion 99 of the C-ring 98 underlies the flexible fingers 70, thereby retaining the anchor body 92 to the support 34 prior to screwing the anchor rod 38 to the anchor body 92 and the support 34. The extending portion 99 of the C-ring 98 provides a surface for presenting to the concrete when the anchor rod is subjected to tension forces. The portion 99 functions as a shoulder, similar to the function provided by the bottom shoulder portions 78 on the anchor bodies 36 and 82. The anchor body 92 also includes a bottom recess 102 that receives the raised portion 52 of the floor portions 48, thereby lowering the C-ring 98 toward the bottom of the concrete foundation to provide a larger shear cone and consequently a stronger anchorage as discussed above.

Figure 12:
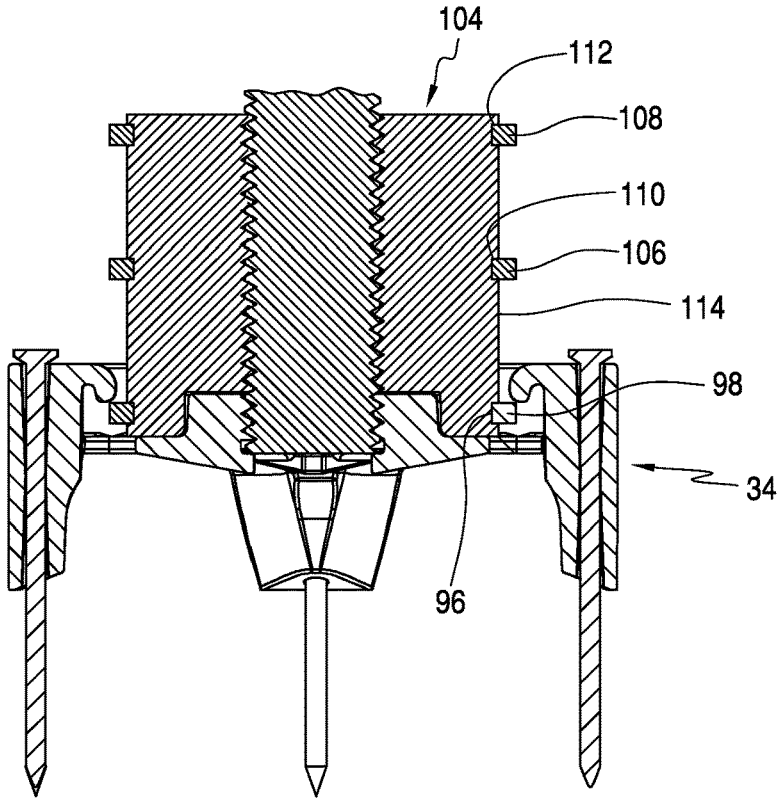
FIG. 12 is a cross-sectional view similar to FIG. 11, showing another embodiment of an anchor body.

Another embodiment of an anchor body 104 is disclosed in FIG. 12. The anchor body 104 similar to the anchor body 92 except for the provision of additional split or C-rings 106 and 108. Respective circumferential grooves 110 and 112 are provided on the cylindrical surface 114 to receive the respective C-rings 106 and 108. Similar to the circumferential groove 96, the grooves 110 and 112 are configured to allow a portion of the C-rings 106 and 108 to extend beyond the cylindrical surface 114 to provide a shoulder with surfaces to present to the concrete when the anchor rod is placed under tension.

It should be understood that the C-rings 98, 106 and 108 may be made integral with the cylindrical anchor bodies 92 and 104, similar to the lower shoulder portion 78 and the shoulder 88 in the anchor bodies 36 and 82.

Figure 13:
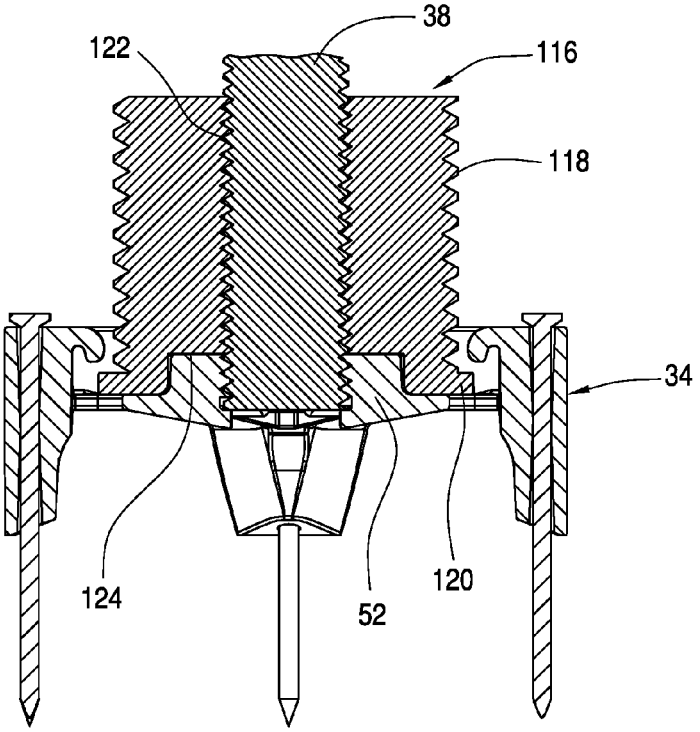
FIG. 13 is a cross-sectional view similar to FIG. 11, showing another embodiment of an anchor body.

Another embodiment of an anchor body 116 is disclosed in FIG. 13. The anchor body 116 is a cylindrical body with a cylindrical surface provide with threads 118. The anchor body 116 has a bottom shoulder portion 120 extending outwardly of the threads 118. The shoulder portion 120 is circumferential and provides a lower horizontal surface for grabbing the concrete to generate a much larger shear cone for a stronger anchorage. The anchor body 116 has a threaded opening 122 for threaded attachment to the anchor rod 38. A bottom recess 124 receives the raised portion 52 of the support 34, thereby lowering the shoulder portion 120. The threads 118 provide multiple surfaces for grabbing the concrete when the anchor is placed under tension.

Figure 14:
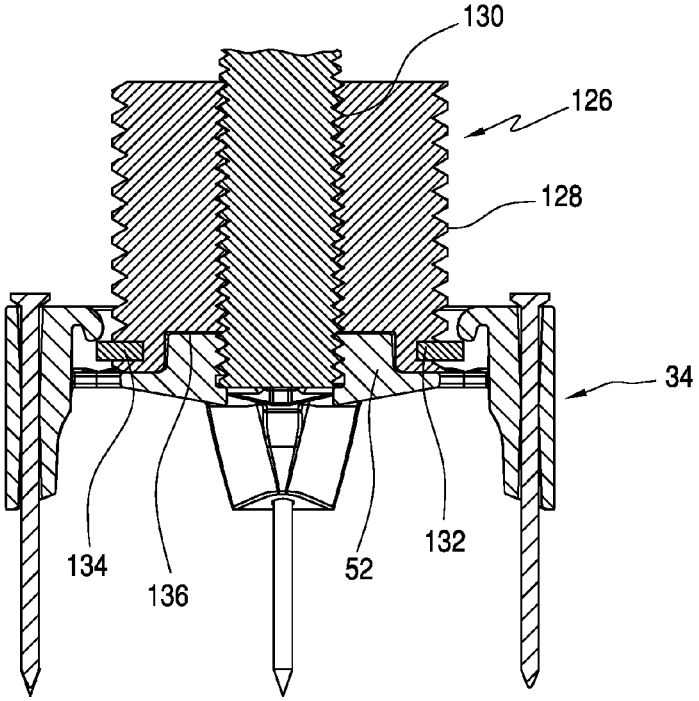
FIG. 14 is a cross-section similar to FIG. 13, showing another embodiment of an anchor body.

Another embodiment of an anchor body 126 is disclosed in FIG. 14. The anchor body 126 is cylindrical with outside threads 128 and a threaded central opening 130 for threaded attachment to the anchor rod 38. A circumferential groove 132 is provided at the bottom portion of the anchor body 126 for receiving a C-ring 134, which is rectangular in cross-section. The groove 132 is configured so that a portion of the C-ring 134 extends radially outwardly beyond the threads 128 to provide a shoulder with surfaces to present to the concrete when the anchor is subjected to tension forces. The threads 128 further provide multiple surfaces that engage the concrete to resist tension forces. The anchor body 126 has a bottom recess 136 that receives the raised portion 52 of the support 34 to lower the C-ring 134 relative to the bottom of the concrete foundation.

Figure 15:
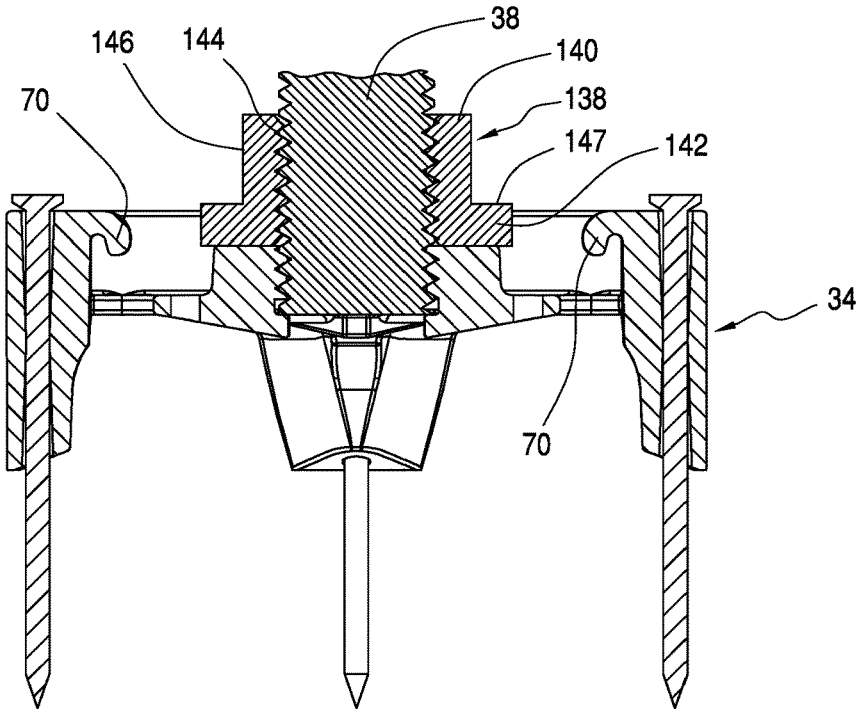
FIG. 15 is a cross-sectional view of similar to FIG. 5, showing another embodiment of an anchor body.

Another embodiment of an anchor body 138 is disclosed in FIG. 15. The anchor body 138 has a cylindrical portion 140 and a shoulder portion 142 at the bottom portion at the cylindrical portion 140. The anchor body 138 has a threaded central opening 144 for threadedly securing to the anchor rod 38. The shoulder portion 142 extends radially outwardly beyond the cylindrical surface 146 of the cylindrical portion 140. The shoulder portion 142 provides a horizontal surface 147 for grabbing the concrete when the anchor is subjected to tension forces. The anchor body 138 may be used in applications where a larger shear cone is not necessary or where the anchor may be embedded deeper in the concrete structure, thereby producing a larger shear cone without the need to lower the shoulder portion 142.

Figure 16:
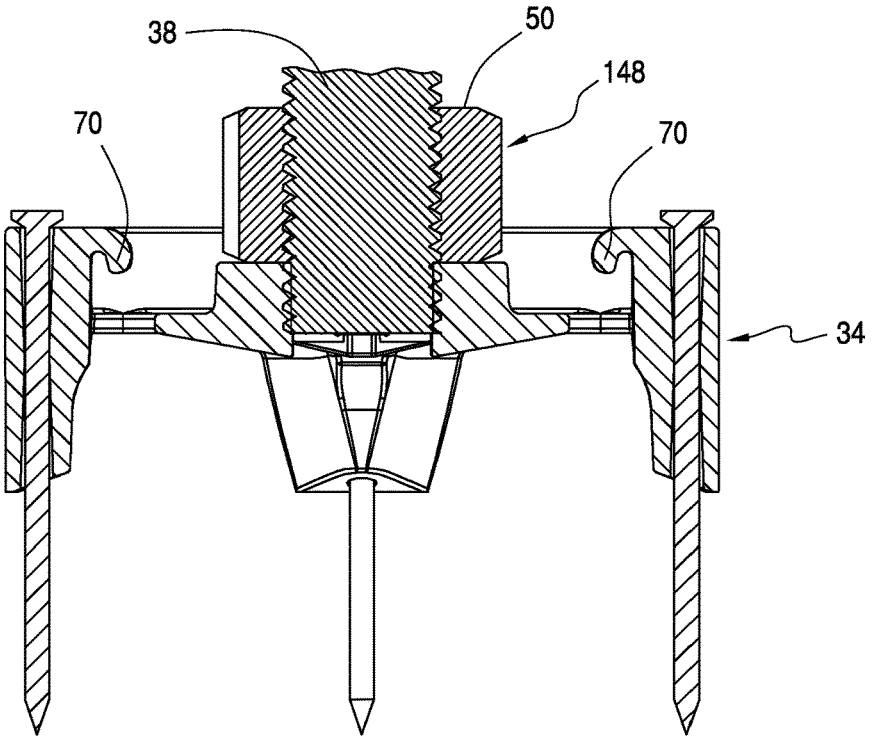
FIG. 16 is a cross-sectional view similar to FIG. 5, showing another embodiment of an anchor body.

Another embodiment of an anchor body 148 is disclosed in FIG. 16. The anchor body 148 is a hexagonal nut threadedly secured to the anchor rod 38. The top surface 150 of the anchor body 148 provides the grabbing area for resisting tension forces when the anchor is subjected to tension forces. The use of anchor body 148 may be used in applications where a larger shear cone is not necessary or where the anchor may be embedded deeper in the concrete structure, thereby producing a larger shear cone even though the surface 150 is not lowered.

The support 34 when used with the anchor bodies 138 and 148 may be modified to eliminate the flexible fingers 70, since the anchor bodies 138 and 148 do not have portions that extend below the flexible fingers 70.

Referring to FIG. 17, the support 34 is nailed to the form board 152, which is part of a concrete form, using the pre-installed nails 40. The anchor rod 38 is screwed to the anchor body 82 and to the threaded opening 44 in the support 34. It will be noted that there is clearance underneath the floor portion 48 of the support 34, allowing concrete slurry to freely flow, thereby minimizing or eliminating air pocket formation underneath the support. The leg portions 50 are spaced apart from each other to provide several inlets and outlets for the concrete slurry to flow underneath the support. Concrete is poured up to a certain thickness as indicated by line 154. After the concrete has cured, the form board 152 is removed, revealing the bottom surfaces of the leg portions 50. Since the support 34 is color coded, an inspection of the exposed surfaces can indicate whether the right anchor has been installed. The support 34 allows the bottom shoulder of anchor body to be lowered toward the bottom of the concrete structure to provide a larger shear cone and thus a stronger anchorage, particular where the depth of the concrete structure, such as a shallow concrete deck, would have been limiting.

When tension is applied on the anchor rod 38, a shear cone 156 will develop. The side of the shear cone 156 is 35° from the horizontal and starts at the lowest engagement points between the anchor body and the concrete, in this case the shoulder portion 78 for the embodiment of FIG. 10. The lower the engagement points are, the larger will the base 158 of the shear cone be, thereby providing a stronger anchorage.

Figure 18:
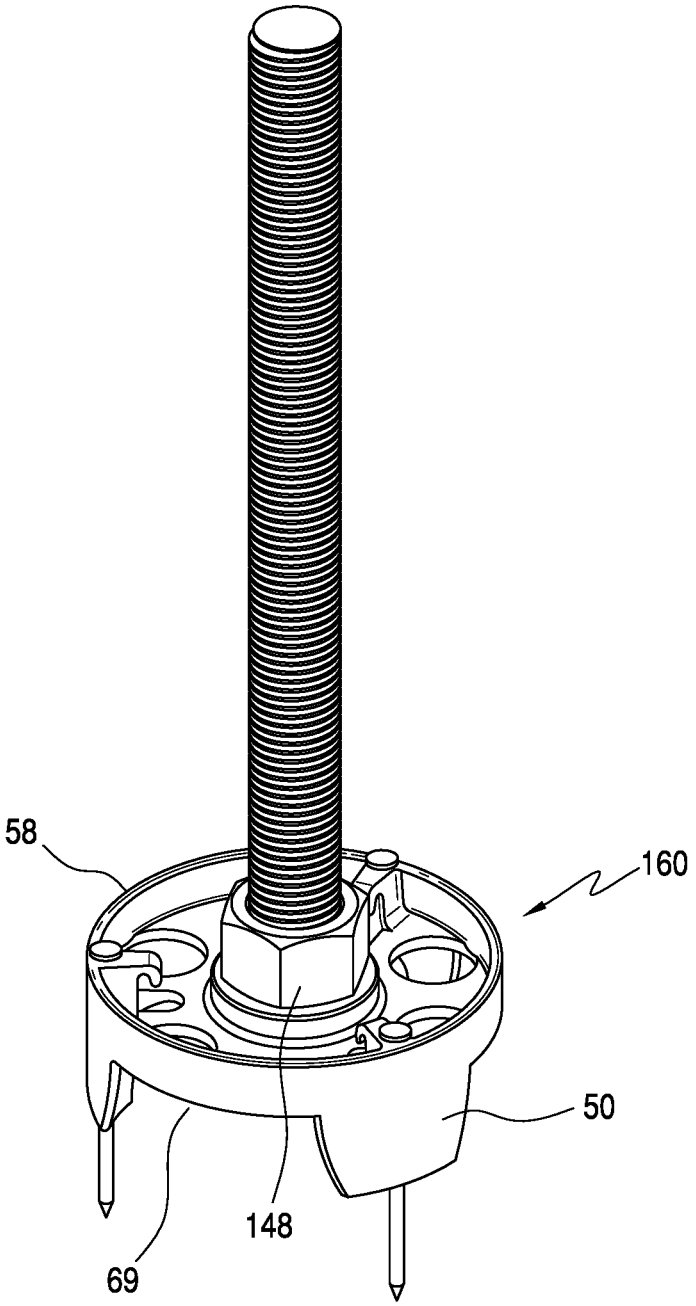
FIG. 18 is a top perspective view of another embodiment of an anchor using a support with three legs.
Figure 19:
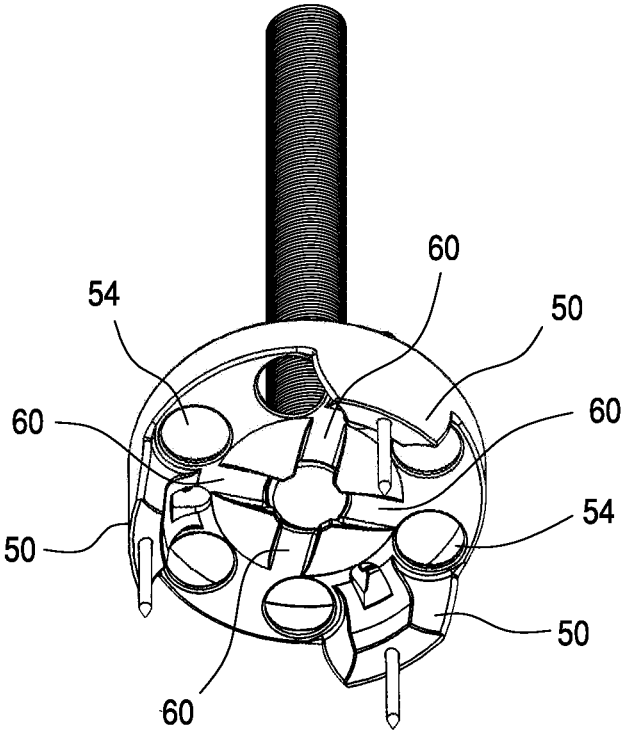
FIG. 19 is a bottom perspective view of FIG. 18.

Another embodiment of a support 160 is disclosed in FIGS. 18 and 19. The support 160 is similar to the support 34, except that the support 160 has three leg portions 50, arranged equidistantly around the cylindrical wall portion 58. With three leg portions 50 instead of four, the opening 69 leg portions 50 is much larger. Further, additional openings 54 are provided on the floor portion 48, allowing for additional passageways for the concrete slurry to flow through to underneath the floor portion and for any trapped air underneath to escape.

Figure 20:
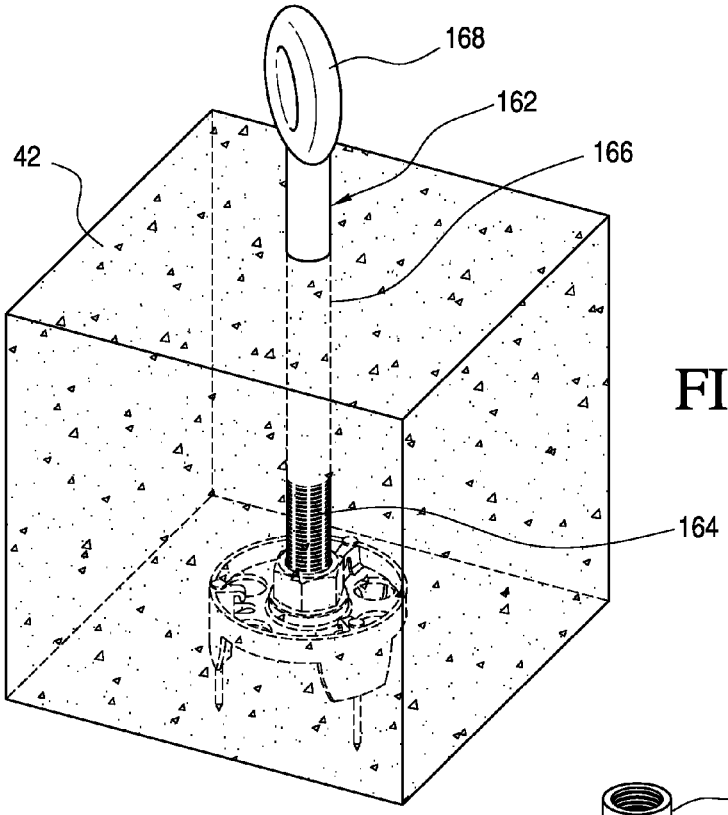
FIGS. 20 and 21 are perspective views similar to FIG. 18, showing different embodiments of the anchor rod.

The anchor 38 need not be threaded throughout its length. Referring to FIG. 20, an anchor rod 162 has a threaded portion 164 and a non-threaded portion 166 that extends beyond the concrete structure 42. The anchor rod 162 terminates into a ring 168 for attaching the anchor to the structure to be anchored, such as the wall 2. The ring 168 is fixed to the anchor rod by welding or other standard means.

Figure 21:
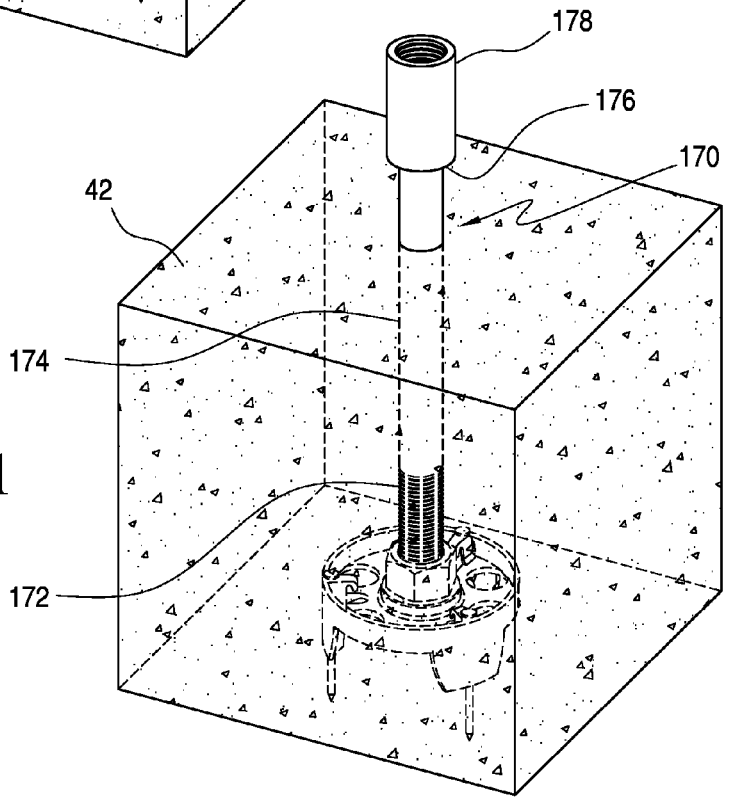

An anchor rod 170 is disclosed in FIG. 21. The anchor rod 170 has a threaded portion 172, a non-threaded portion 174 that extends outside the concrete structure 42, and a threaded portion 176 to which a coupling 178 is threaded. The coupling 178 is another way of connecting the anchor to the structure being secured, such as the wall 2.

Figure 22:
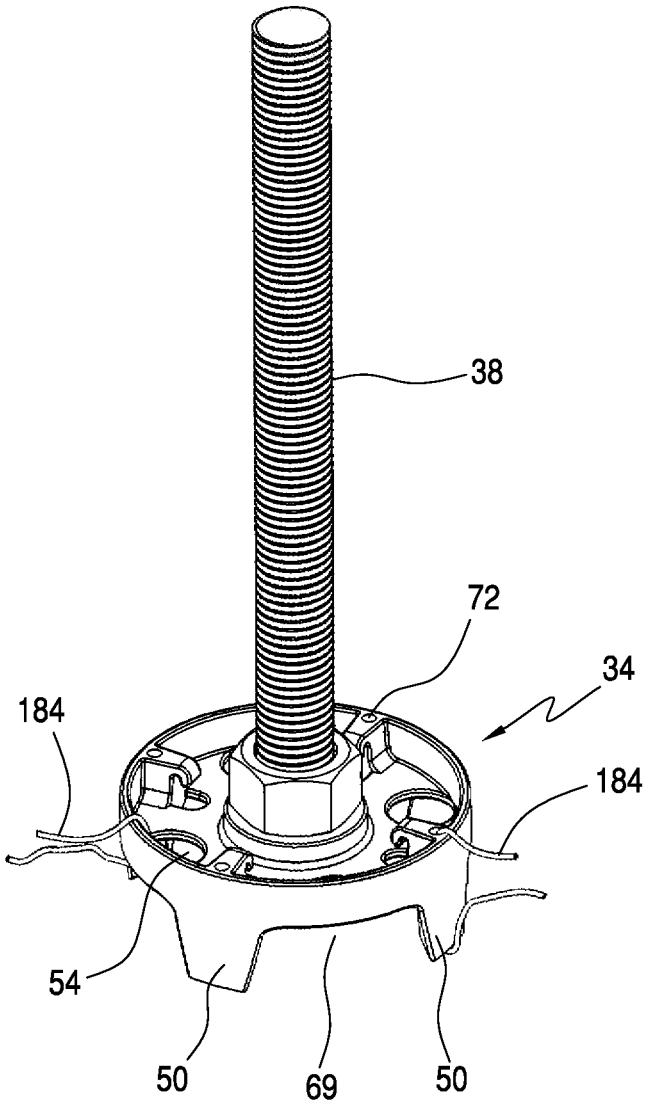
FIG. 22 is a perspective view of the anchor of FIG. 16, showing the nails replaced with tie wires.
Figure 23:
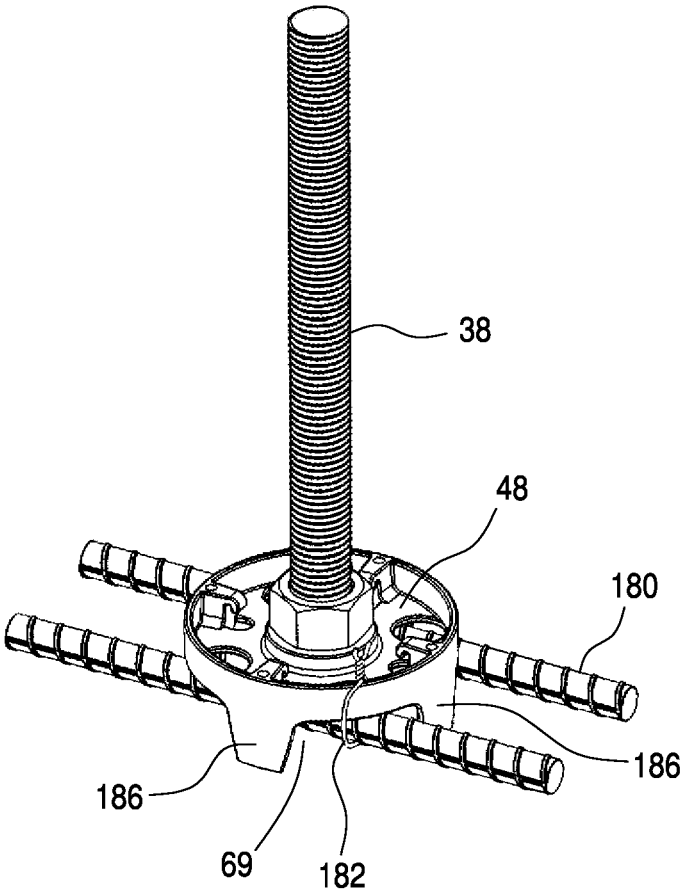
FIGS. 23 and 24 are perspective views of the anchor of FIG. 22 shown secured to rebars using tie wires.
Figure 24:
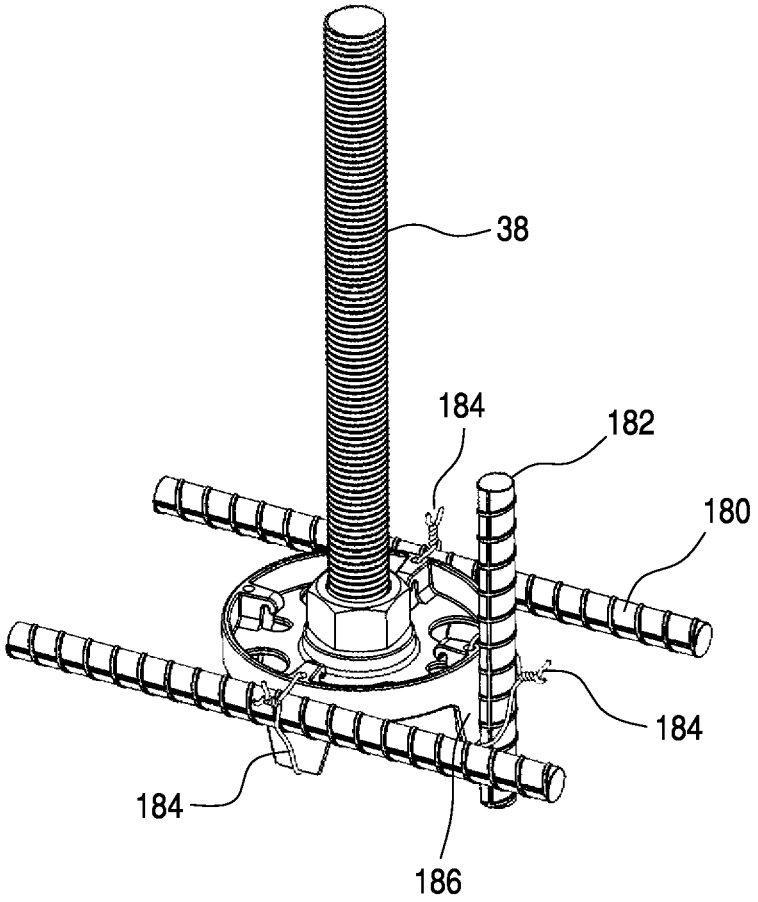

Referring to FIGS. 22-24, the openings 54 and the holes 72 may be used to secure the support 34 to horizontal rebars 180 and/or vertical rebars 182 with tie wires 184. This is an application where the bottom form board may not be accessible for the support 34 to be nailed to or where the concrete form is an excavation on the ground. The tie wires 184 may be pre-installed, as shown in FIG. 22. The openings 69 between the leg portions 50 allow the horizontal rebars 180 to extend underneath the floor portion 48, as shown in FIG. 23. The leg portions 50 have exterior vertical cylindrical surfaces 186 that may be used to line up with the vertical rebar 182, thereby allowing the anchor rod 38 to be vertical.

It should be understood that the support 160 showing three leg portions 50 may also be used with tie wires instead of nails in the manner shown in FIGS. 23 and 24. Further, the various embodiments of the anchor bodies disclosed herein may be used with either the support 34 or 160, with nails or tie wires.

Figure 25:
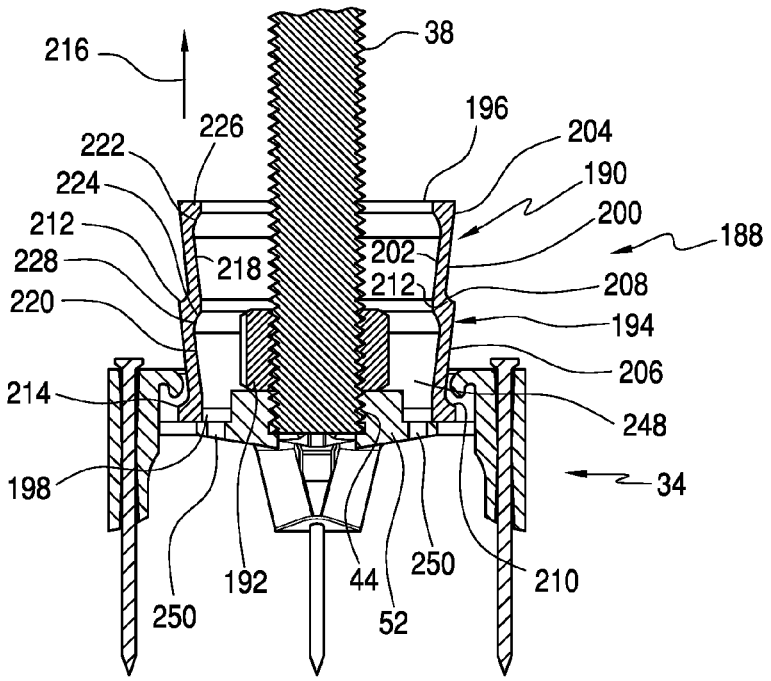
FIGS. 25 and 26 are cross-sectional views similar to FIG. 5, showing various embodiments of the anchor body.

Referring to FIG. 25, another embodiment of an anchor 188 is disclosed. The anchor 188 comprises the anchor rod 38, an anchor body 190, and the support 34. The bottom end of the anchor rod 38 is screwed to the threaded opening 44. A nut 192 is also threaded to the anchor 38 and engages snug against the raised portion 52.

The anchor body 190 is a tubular member, preferably circular in cross-section, with a vertical wall 194 and top and bottom openings 196 and 198. The vertical wall 194 has outside surface 200 and inside surface 202. The outside surface 200 is shaped with a series of recessed profiles, similar to the recessed profiles on the anchor body 82 of FIG. 10. The outside surface 200 has upper and lower downwardly and inwardly projecting surfaces 204 and 206, preferably shaped as inverted conical surfaces. The upper and lower surfaces 204 and 206 preferably terminate into respective outwardly extending curved surfaces 208 and 210 to define respective shoulders 212 and 214. Both shoulders 212 and 214 will generate respective shear cones when load in the direction 216 is applied on the anchor rod 38. The lower shoulder 214 will generate a larger shear cone than the upper shoulder 212 due to its lower position. Multiple shoulders help to distribute the load on the wall 194 and thus make for a stronger anchorage.

The inside surface 202 similarly has upper and lower downwardly and inwardly extending surfaces 218 and 220, preferably shaped as inverted conical surfaces. Each surface 218 and 220 is capped at the top with respective inwardly extending curved surfaces 222 and 224. The surfaces 222 and 224 define respective inverted shoulders 226 and 228.

Figure 26:
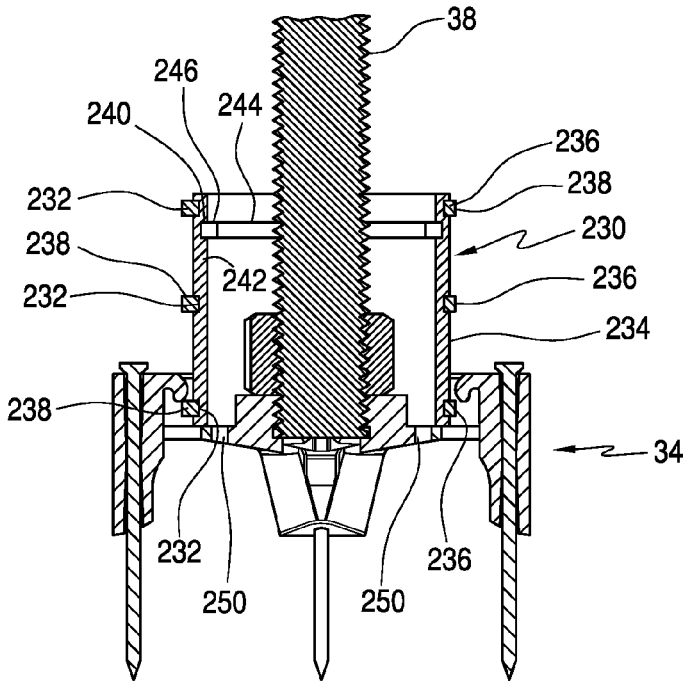

Referring to FIG. 26, the outside shoulders 212 and 214 on the anchor body 190 shown in FIG. 25 may be implemented with a metallic, cylindrical sleeve 230 with a plurality of circumferential grooves 232 on its outside cylindrical surface 234 that partly receive respective split or C-rings 236. Portions of the rings 236 that extend outside the grooves 232 form shoulders 238. The inverted shoulder 226 shown in FIG. 25 is implemented with an inside circumferential groove 240 on an inside cylindrical surface 242 on the sleeve 230 that partly receives a split or C-ring 244 so that a portion of the ring extends outside the groove 240 to form a shoulder 246.

Referring back to FIG. 25, concrete slurry fills up the interior space or void 248 within the anchor body 190 when the anchor 188 is embedded in the concrete structure, with the upper portion of the anchor rod 38 extending out of the structure for attachment to a load, such as another structure required to be anchored. Openings 250 on the floor portion 48 communicate with the void 248 to minimize formation of air pockets inside the anchor body 190. When tension is applied on the anchor rod 36 in the upward direction 216, the concrete mass within the void 248 becomes subject to compression forces, as the inverted shoulders 226 and 228 deflect the upward force toward the nut 192 and the threads of the anchor rod 38 located within the anchor body 190. Accordingly, the anchor body 190 becomes a solid member, securely attached to the anchor rod 38, thereby allowing the outside shoulders 208 and 210 to counteract the pulling or tensile load on the anchor rod 38.

It should be understood that although the anchor disclosed herein has been described for holding a structure, such as a wall, toward the foundation structure or concrete deck, the anchor can also be used to support any tensile load imposed on the anchor rod in any direction, such as a hanging weight, side attachment to a concrete column, attachment of a structure to underneath a concrete deck, etc. Accordingly it would be seen from the description that the anchor when embedded in a concrete structure will resist a tensile load on the anchor rod, regardless of the orientation of the direction of the tensile force.

Figure 27:
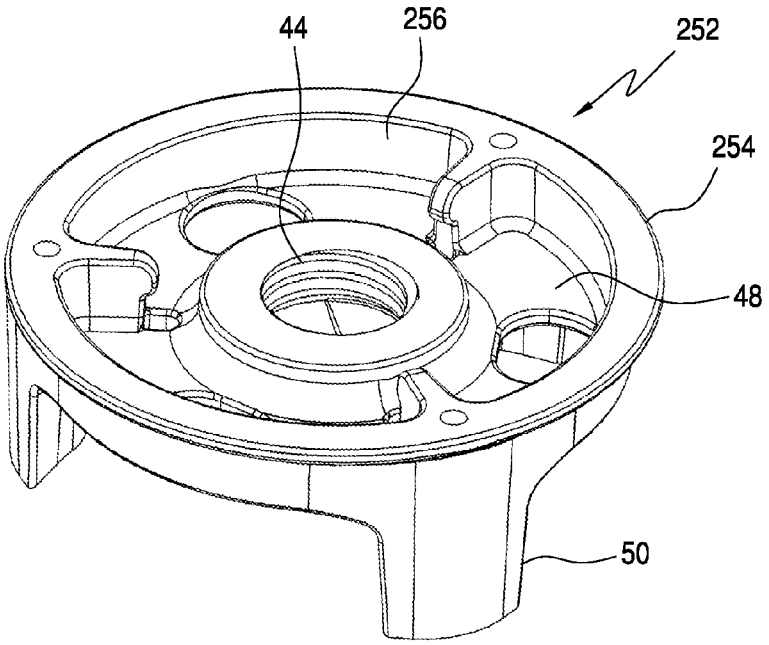
FIG. 27 is a top perspective view of another embodiment of an anchor rod support embodying the present invention.
Figure 28:
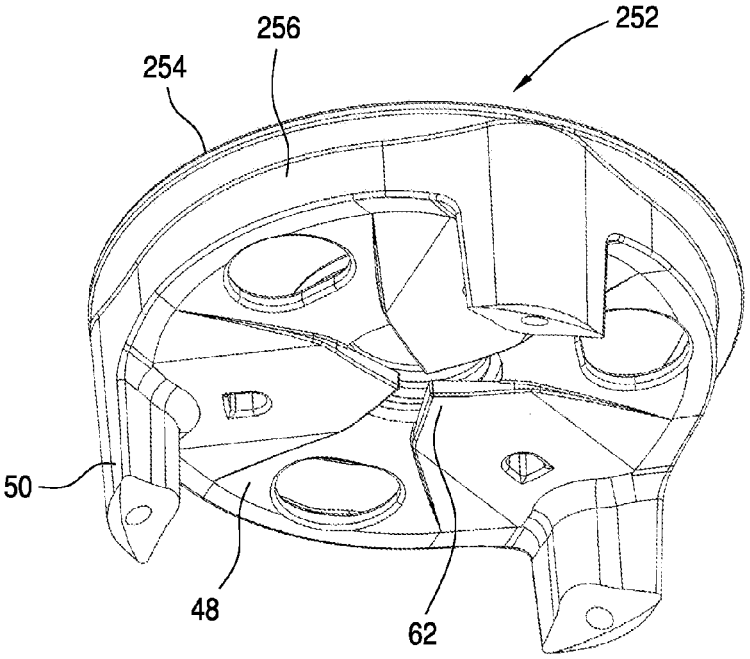
FIG. 28 is a bottom perspective view of the support shown in FIG. 27.

Another embodiment of an anchor rod support 252 is disclosed in FIGS. 27 and 28. The support 252 includes an annular flange 254 that provides additional rigidity to the peripheral vertical wall 256. As in the embodiment of the support 34 shown in FIG. 6, the support 252 includes leg portions 50 supporting a floor portion 48. The threaded central opening 44 also includes the projections 62 disposed at the bottom thereof for providing a stop to an anchor rod to be screwed into the opening 44. All the other structural features disclosed in the support 34 are also included in the support 252.

Figure 29:
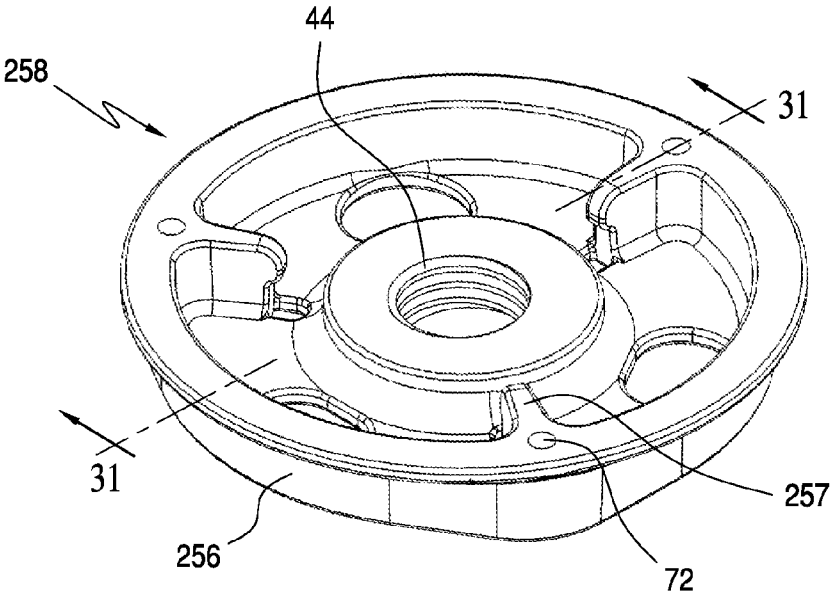
FIG. 29 is a top perspective view of another embodiment of an anchor rod support embodying the present invention.
Figure 30:
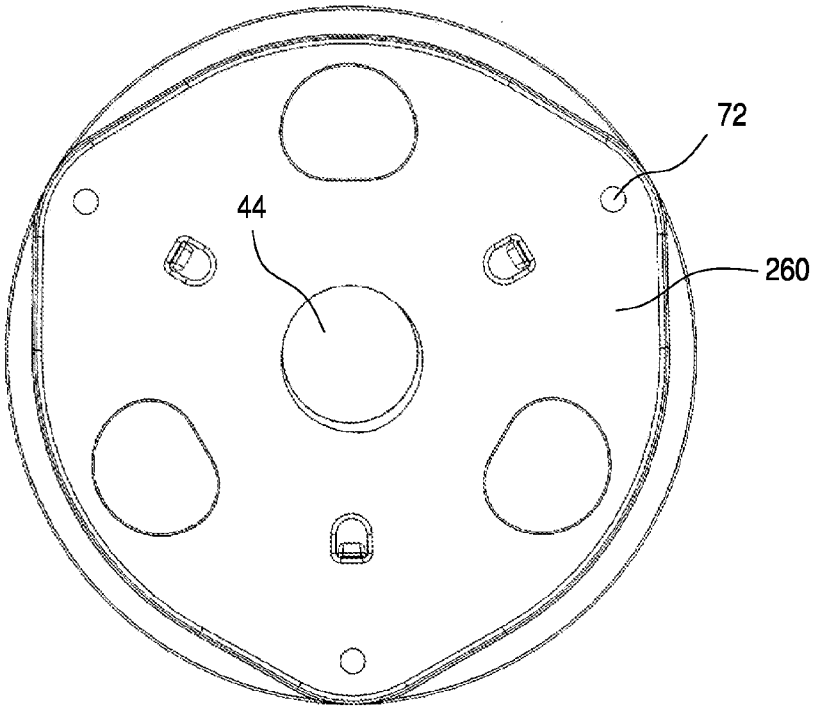
FIG. 30 is a bottom view of the support shown in FIG. 29.
Figure 31:
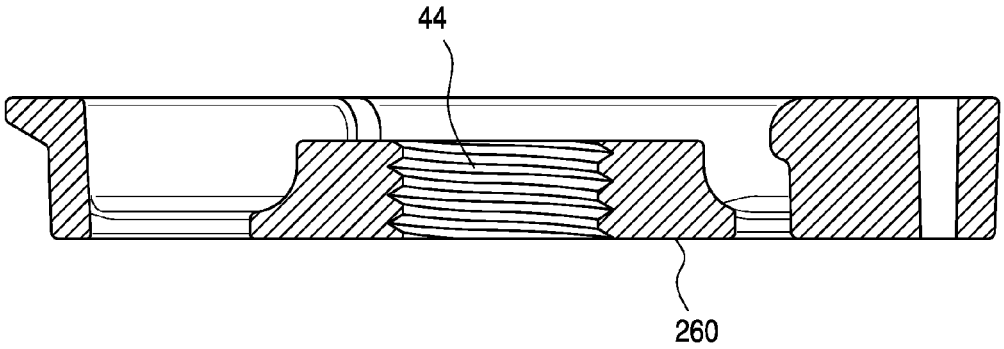
FIG. 31 is a cross-sectional view taken along 31-31 in FIG. 29.

Another embodiment of an anchor rod support 258 is disclosed in FIGS. 29-31. The support 258 is similar to the support 252, without the leg portions 50. The support 258 has a substantially flat bottom surface 260 that allows the support to be placed on top of a concrete or CMC block foundation wall that typically supports a concrete slab. The support 258 can be nailed to the foundation wall through the vertical holes 72 with a powder-actuated nail driver. The holes 72 are disposed through radially and vertically extending rib portions 257 that advantageously give rigidity to the floor portion 48 and the peripheral vertically wall 256. Any of the anchor bodies attached to an anchor rod, which is in turn screwed to the threaded opening 44, as disclosed above, may then be placed much lower in the concrete where it is embedded. The support 258, just like the other embodiments of the support disclosed herein above, has a generally circular shape in plan view with an overall diameter that locates the anchor rod screwed to the opening 44 to be centered in a 2×4 wall bottom plate.

Figure 32:
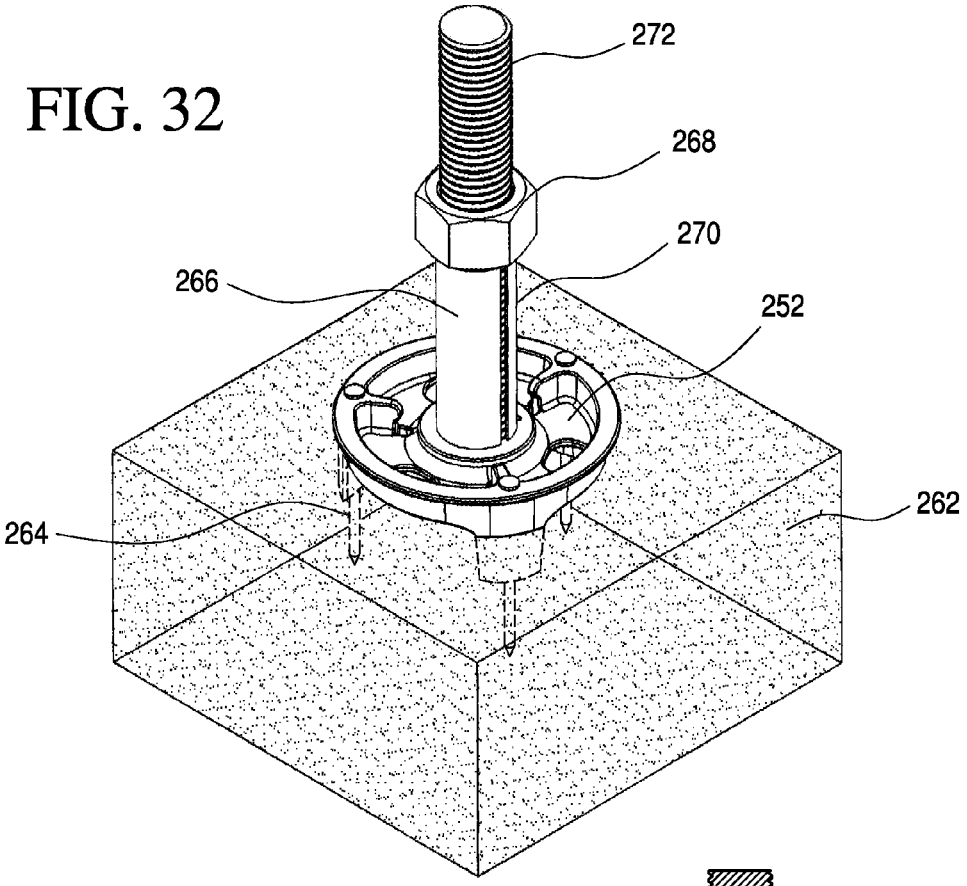
FIG. 32 is top perspective view of the anchor rod support of FIG. 27, shown with its legs sunk into a sand base and shown with an attached anchor rod with an anchor body spaced at a required distance above the sandy base.

Referring to FIG. 32, the wedge shape of the leg portions 50 of the support 34, 160 and 252 advantageously allows penetration into a sand base 262 onto which concrete is poured. The bottom portion of the floor portion 48 rests on the sand base and provides a stop to prevent the support from sinking any further into the sand base. The sunken leg portions 50 securely place the support prior to concrete pouring. Nails 264 provide further stability. A tubular spacer 266 locates an anchor body, such as the nut 268, above the floor portion and a distance from the sand base 262, typically 3" as required by building code. The spacer 266 may be made of cardboard or other pliable material so that the longitudinal cut or slot 270 may be expanded to greater than the diameter of the anchor rod 272 and so that the spacer can be positioned around the anchor rod 272. The distance minimizes corrosion over time. Other means may be used to locate the anchor body the required distance from the sand base, such as by actual measurement in the field, or by sticking a tape around the anchor rod at the required distance. The spacer 270 or a tape may be color coded to indicate the offset requirement.

Figure 33:
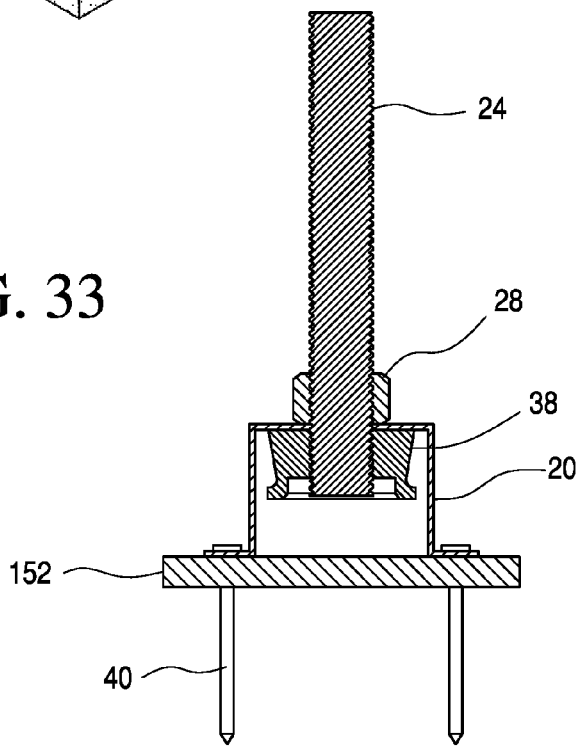
FIG. 33 is a cross-section view of an anchor rod assembly, including an anchor body disposed underneath an anchor rod support.

Referring to FIG. 33, an anchor body, such the anchor body 38, may be disposed underneath the anchor rod support 20. The anchor rod 24 is secured to the support 20 by the nut 28. The nails 40 attach the support 20 to the form board 152. The placement of the anchor body underneath the support 20 advantageously lowers the position of the anchor body within the concrete where it is embedded to provide a larger shear cone and thus provide a stronger anchorage.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An anchor assembly embedded in concrete, comprising:

a) a support having a floor and legs extending downwardly from said floor, said support being embedded in concrete, said floor including an opening with a bottom stop;

b) a rod having one end disposed in said opening, said bottom stop for preventing said one end from going past said bottom stop;

c) a nut threaded to said rod, said nut being embedded in concrete; and d) said nut is attached to said floor.

2. An anchor assembly as in claim 1, wherein said support includes openings between said legs.

3. An anchor assembly as in claim 1, wherein said support is molded.

4. An anchor assembly as in claim 1, wherein said support is U-shaped made of sheet metal.

5. An anchor assembly as in claim 1, wherein said support includes threads.

6. An anchor assembly as in claim 1, wherein said bottom stop includes a projection extending into said opening.

* * * * *